US010765930B2

(12) United States Patent
Gunderson

(10) Patent No.: US 10,765,930 B2
(45) Date of Patent: Sep. 8, 2020

(54) TRAP DOOR MECHANISM FOR CARD HANDLING DEVICES SUCH AS CARD SHUFFLERS

(71) Applicant: AGS LLC, Las Vegas, NV (US)

(72) Inventor: Bjorn Gunderson, Chicago, IL (US)

(73) Assignee: AGS LLC, Las Vegas, NV (US)

( * ) Notice: Subject to any disclaimer, the term of this patent is extended or adjusted under 35 U.S.C. 154(b) by 110 days.

(21) Appl. No.: 15/990,339

(22) Filed: May 25, 2018

(65) Prior Publication Data

US 2018/0345122 A1 Dec. 6, 2018

Related U.S. Application Data

(60) Provisional application No. 62/512,931, filed on May 31, 2017.

(51) Int. Cl.

| | |
|---|---|
| ***A63F 1/12*** | (2006.01) |
| *A63F 1/06* | (2006.01) |
| *A63F 9/24* | (2006.01) |

(52) U.S. Cl.

CPC ..... *A63F 1/12* (2013.01); *A63F 1/067* (2013.01); *A63F 2009/2482* (2013.01)

(58) Field of Classification Search

CPC .... A63F 1/12; A63F 1/067; A63F 1/10; A63F 1/14; A63F 2009/2482; A63F 2003/00164; A63F 3/00157

USPC ..... 273/149 R

See application file for complete search history.

(56) References Cited

U.S. PATENT DOCUMENTS

| | | | | |
|---|---|---|---|---|
| 5,096,197 | A | 3/1992 | Embury | |
| 6,651,982 | B2 | 11/2003 | Grauzer et al. | |
| 7,036,818 | B2 | 5/2006 | Grauzer et al. | |
| 7,523,935 | B2 | 4/2009 | Grauzer et al. | |
| 7,854,430 | B2 | 12/2010 | Toyama | |
| 7,988,152 | B2 | 8/2011 | Sines | |
| 8,109,514 | B2 | 2/2012 | Toyama | |
| 8,366,109 | B2 | 2/2013 | Soltys | |
| 8,602,416 | B2 | 12/2013 | Toyama | |
| 2013/0147166 | A1 | 6/2013 | Cowelchuk et al. | |
| 2015/0238848 | A1* | 8/2015 | Kuhn | A63F 1/12 273/149 R |
| 2016/0310831 | A1* | 10/2016 | Chun | A63F 3/00157 |

* cited by examiner

*Primary Examiner* — John E Simms, Jr.
*Assistant Examiner* — Rayshun K Peng
(74) *Attorney, Agent, or Firm* — Weide & Miller, Ltd.

(57) ABSTRACT

A card shuffler or other card handling apparatus defines a card receiving and/or dispensing area that accepts cards. The card shuffler also includes a shuffling compartment. A trap door is provided to transport the cards from the receiving and/or dispensing area to the shuffling compartment.

14 Claims, 5 Drawing Sheets

TRAP DOOR MECHANISM FOR CARD HANDLING DEVICES SUCH AS CARD SHUFFLERS

CROSS-REFERENCE TO RELATED APPLICATION

This application claims priority to U.S. Provisional Application No. 62/512,931 which was filed on May 31, 2017, the contents of which are hereby incorporated by reference.

BACKGROUND

Playing cards are used in a wide variety of games. When playing cards are used to play games in a casual setting, such as in the home, the cards are generally processed manually. In other words, the cards may be shuffled by hand, dealt by hand and the like.

In many environments, hand processing of cards for game play is undesirable or has drawbacks. For example, in a casino environment is important to ensure that the cards are not tampered with (where that risk increases the more the cards are handled by hand), that the cards are well shuffled (thus ensuring a high degree of randomization), and that the card handling is expedited so that games can be played quickly.

Thus, to address these issues, several card-handling devices have been created. For example, to facilitate thorough and quick shuffling of cards, various mechanical or electro-mechanical card shuffling devices have been developed. In addition, other types of card handling, receiving, transporting and retaining devices have been developed. The industry continually seeks for improvements to such devices to further increase the speed of shuffling, the ease of use, and other aspects of the devices.

SUMMARY

Accordingly, an improved shuffling device and a trap door that may be used for a shuffling device are provided. The shuffling device according to the disclosed embodiments allows for a deck of cards to be placed face down in a receiving area of the shuffler, while automatically rotating the cards and dropping them into a vertical card shuffling compartment. In one embodiment, a card shuffler or other card handling apparatus defines a card receiving and/or dispensing area that accepts cards. The card shuffler also includes a shuffling compartment. A trap door is provided to transport the cards from the receiving and/or dispensing area to the shuffling compartment.

In another embodiment, a trap door is provided that is configured to provide access to a compartment. In one instance, the trap door is operably driven by an associated device to move in coordination with the associated device. The associated device may be a sweeper arm for a card shuffling device.

Further objects, features, and advantages of the present invention over the prior art will become apparent from the detailed description of the drawings which follows, when considered with the attached figures.

DETAILED DESCRIPTION OF EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The disclosed embodiments described herein provide improvements and modifications to a card shuffling apparatus or other card receiving, processing, dispensing or retaining devices. Various embodiments of a card shuffling apparatus to which the present invention is applicable are disclosed in U.S. Pat. No. 8,602,416 ("the '416 patent"), the contents of which are incorporated by reference in their entirety. However, the present invention is, as indicated above, applicable to other configurations of card shuffling apparatus and various other card handling devices.

Figure 1:
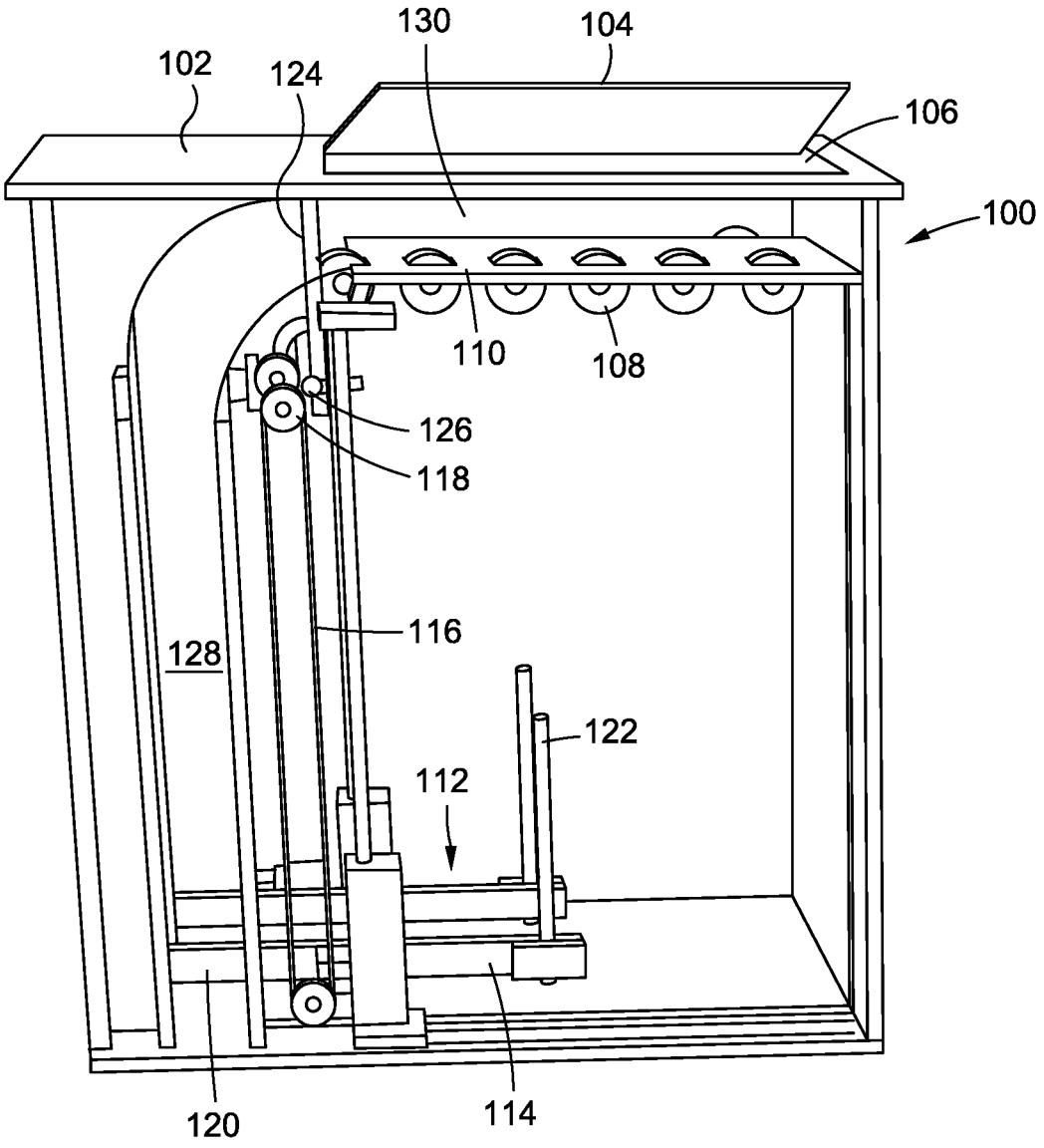
FIG. 1 shows an exemplary shuffling apparatus.

For example, as explained in more detail in the '416 patent, an exemplary shuffling apparatus is shown in FIG. 1. Some specific details of the shuffling mechanism are not shown in FIG. 1 but are more particularly described in the '416 patent. For example, the particulars of a shuffler mechanism, a card counting device, and many of the associated belts, motors, sensors, and the like, that are associated with providing the motive force and control inputs needed for the functioning of the overall apparatus are omitted here for brevity.

In FIG. 1, a shuffling apparatus 100 comprises a top plate 102 which may serve to form an interface with the top of a gaming table (not shown) and another plate 104 may be affixed thereto to form a swinging or sliding door in the top plate 102. The plate 104 covers an aperture 106 in the apparatus 100 that allows a deck of cards 15 (or more than one deck or partial decks; such decks might comprise standard 52 card decks having a back and a front, where the front or face displays card suit and rank information, such as card ranks of 2, 3, 4, 5, 6, 7, 8, 9, 10, Jack, Queen, King and Ace, in each of the suits Hearts, Spades, Clubs and Diamonds; such a deck might include one or more Jokers, and other/might comprise other types of cards bearing other information) to be introduced into the apparatus 100, or be removed from the apparatus 100. In essence, the aperture 106 comprises an area 130, such as a recessed area, which serves as a card receptacle, such as a card dispensing and/or receiving area 130.

When the plate (lid) 104 is opened, a user may place a deck of cards 15 (in this configuration, in a horizontal position) into a receiving area 130 at the aperture 106, such as so that they rest on a bottom or support plate 110 within the apparatus 100. A horizontal card transport assembly 108 is provided for moving the deck of cards from the card receiving area 130 into the interior of the apparatus 100 to a shuffler mechanism. This horizontal card transport assembly 108 may comprise a series of rollers projecting through a support plate 110. The rollers may be rotated in unison by a belt, which may be a toothed belt, or a smooth belt. Alternatively, the transport mechanism may be a continuous belt, may include pushers to move the deck of cards 15 along the support plate 110, or the like. The horizontal card transport assembly 108 may be actuated to move a deck of cards 15 from a right-hand-end of the apparatus to a left-hand-end of the apparatus (relative to the configuration illustrated in FIG. 2). In some designs, the belt may also be controllable to also translate in both directions to assist in positioning the cards for dispensing. Here, a shuffling compartment 128, of which the card shuffling apparatus may form a bottom portion thereof, is positioned at the left-hand-end of the horizontal card transport assembly 108. An elevator 112, including horizontal support arms 114 and a lifting belt 116 engaging with drive sprockets 118 operates to lift a deck of cards into and out of the shuffling compartment 128 while the cards rest on distal ends 120 of the horizontal support arms 114.

Figure 2:
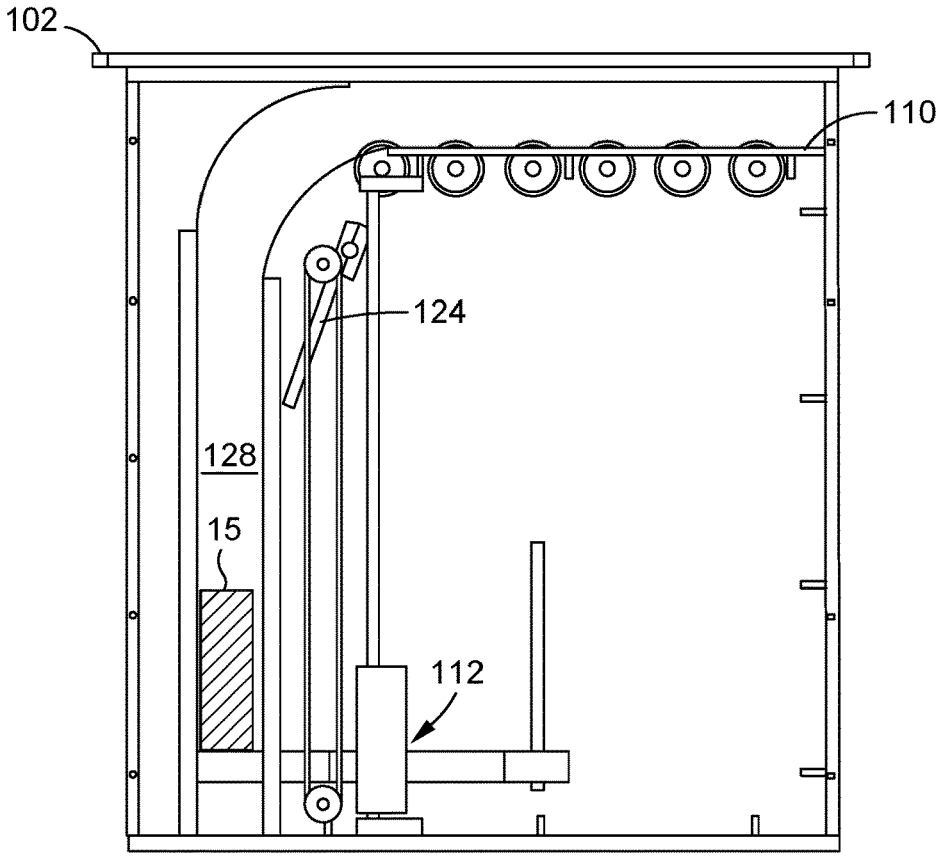
FIG. 2 shows a side view of the shuffling apparatus in FIG. 1.

As illustrated in FIG. 1, a pair of vertical shafts 122 may be affixed to the elevator 112 so that they rise and fall with the motion of the elevator 112. As illustrated in FIG. 2, a lift gate 124, such as in the form of a pair of spaced sweeper arms (shown in one embodiment in FIG. 2 and in another embodiment or form in FIGS. 4 and 5), is movable, such as by being rotatable about shaft 126 from a vertical position to a position about 180 degrees opposed thereto, depending on the state of the shuffling apparatus.

In the first state, a deck of cards is inserted through the top aperture 106 to be positioned in the card receiving area 130. The lift gate 124 (which may also be referred to as a sweeper arm or arms) may be rotated so that it does not obstruct the top of shuffling compartment 128 (FIGS. 1 and 2). Referring to FIG. 2, the elevator mechanism 112 may be operated along with the horizontal transport mechanism 108 to move the deck of cards 15 so that they fall into the shuffling compartment 128 or to otherwise move or transport the deck of cards 15 into the interior of the card shuffling device to a shuffler mechanism (FIG. 2).

FIG. 2 shows a side view of the shuffling apparatus 100 in a second state to shuffle the deck of cards 15 (once they have been delivered to the shuffling compartment 128 as described above). In this second state, a card shuffling operation may be performed in any manner, as is disclosed in the '416 patent. After completion of the card shuffling operation, the cards may be counted, providing a card counting device has been installed, for example, in the compartment 128 or aperture 106.

In the third state, the elevator 112 is actuated to raise the deck of cards 15 to position them near the top of the shuffling compartment 128 and/or into the aperture 106. The sweeper arm 124 may be utilized to move the deck of cards 15 from the elevator 112 to the horizontal transport mechanism 108 (such as by having the sweeper arms 124 rotate from a position under the aperture 106 in a clockwise direction in FIG. 2 to push the deck of cards from left to right in that figure). In this configuration, the aperture 106 comprises or defines a card receptacle which includes or defines a card receiving/dispensing area 130. However, in other embodiments, distinct areas might serve as separate locations to receive and dispense cards, or the areas might be completely separate (and not part of the same aperture/receptacle area).

The shuffled deck of cards 15 may then be removed for use. The process may be repeated wherein another new or previously used deck of cards may be introduced into the receiving area 130. The removal of the cards from the area 130, and the presence of cards at position 130 may be sensed and used to initiate another shuffling cycle. The top cover 104 may be closed during the cycle and after use.

Ancillary equipment such as a power supply, which may be batteries, an AC-DC converter (battery eliminator), an AC power supply, a controller, or the like, are not shown as they are well known to persons of ordinary skill in the art, as are the various types of motors, displays, solenoids, control interfaces and the like.

Figure 3:
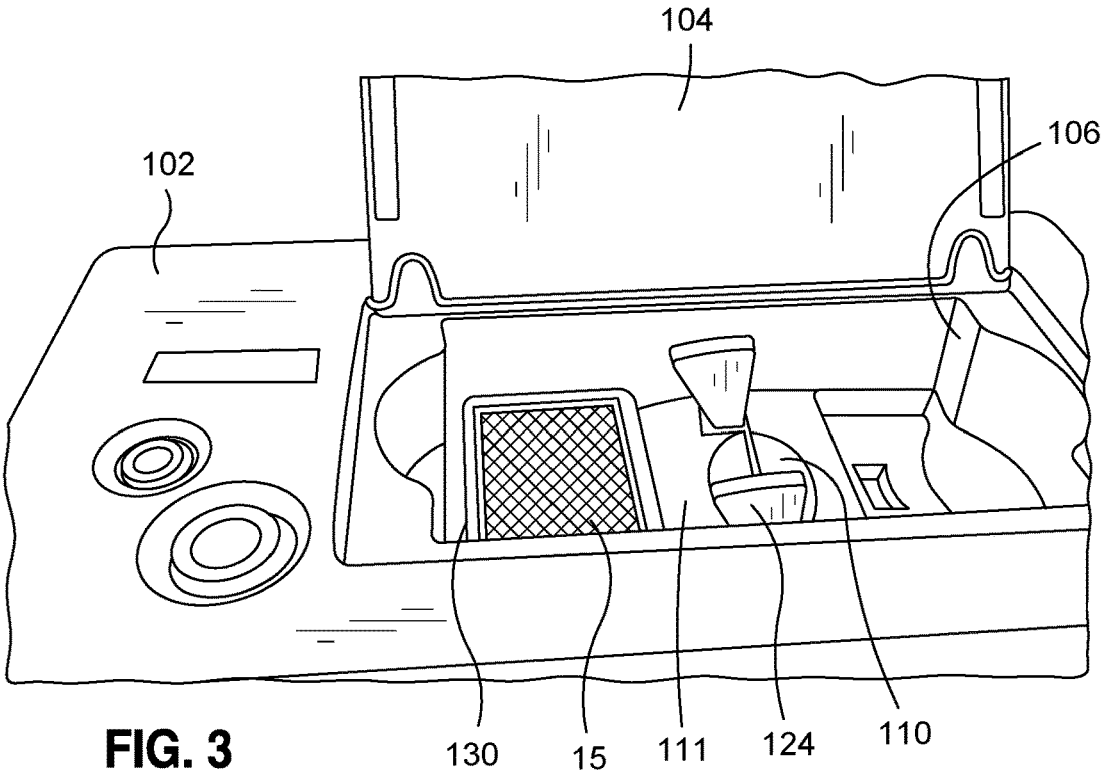
FIG. 3 shows a top perspective view of a shuffling apparatus according to one embodiment of the invention in a first state to shuffle cards.
Figure 4:
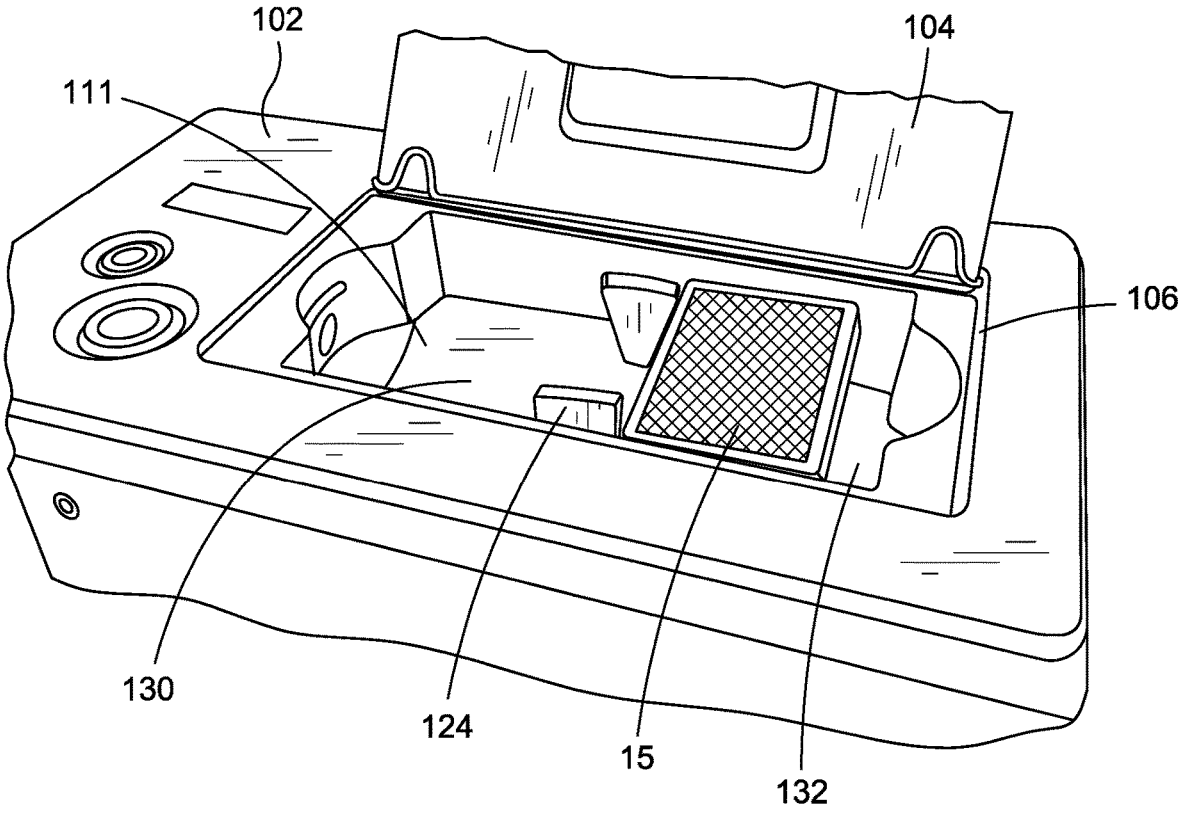
FIG. 4 shows a top perspective view of the shuffling apparatus of FIG. 3 in a second state to dispense cards.

In the embodiment just described, cards are moved from the card receiving area 130 to the shuffling compartment 128 via one or more horizontal transport devices or by otherwise moving them generally horizontally. In other types of shuffling devices, cards may be moved from a card receiving area to a card shuffling area by one or more elevators or the like. These elevators, horizontal transport devices and the like have various drawbacks, such as increasing the cost and complexity of the machine and resulting in higher rates of failure and required repair. Accordingly, embodiments disclosed herein comprise a trap door mechanism for a card handling device, such as a card shuffler. Relative to the card shuffler described above, a trap door mechanism is provided, as shown in FIGS. 3 and 4. The trap door mechanism is preferably used to move cards from the card receiving area 130 (FIG. 1) to a shuffling compartment (such as the shuffling compartment 128 shown in FIGS. 1 and 2), such as in replacement of one or more aspects of the horizontal transport mechanism. In other types of shufflers, the trap door mechanism may be used in replacement of the card elevator(s). In addition, the present invention has an advantage over such prior art card handling or transport mechanisms that cards to be shuffled are moved from a horizontal position to a vertical position (for shuffling) and then returned back to a horizontal position for retrieval from the shuffling apparatus 100, without the need for any horizontal transport mechanism (which reduces the complexity and cost of such a card handling device or shuffler as compared to when horizontal card transport mechanisms are required).

For example, relative to the shuffler which is illustrated in FIG. 3, instead of using rollers or the like to move the cards, the support plate 110 may include a trap door 111 in the card receiving area 130. The trap door 111 may be configured to move between at least a first card supporting position where the trap door 111 is fixed in a generally horizontal position (and thus essentially forms a portion of the bottom 110 of the aperture 106), and a second delivery position where the trap door 111 swings into a generally vertical position where the cards are no longer supported by the trap door and thus fall downwardly into a shuffling compartment (such as shuffling compartment 128 in FIGS. 1 and 2). In this configuration, the deck of cards 15 is placed in the receiving area 130 on top of the trap door 111. To begin shuffling the cards, the trap door 111 is opened to allow the cards to fall, or be transported by an elevator mechanism 112 (or other card guide or transport mechanism), into the compartment 128 (FIGS. 1 and 2). The trap door 111 may be controlled by a series of switches, motors, pulleys, and/or belts as is now known or later developed and may move in various manners (swing, rotate, slide, etc.). Other suitable mechanisms may also be used to transfer the cards from the receiving area 130 to the compartment 128.

Figure 5:
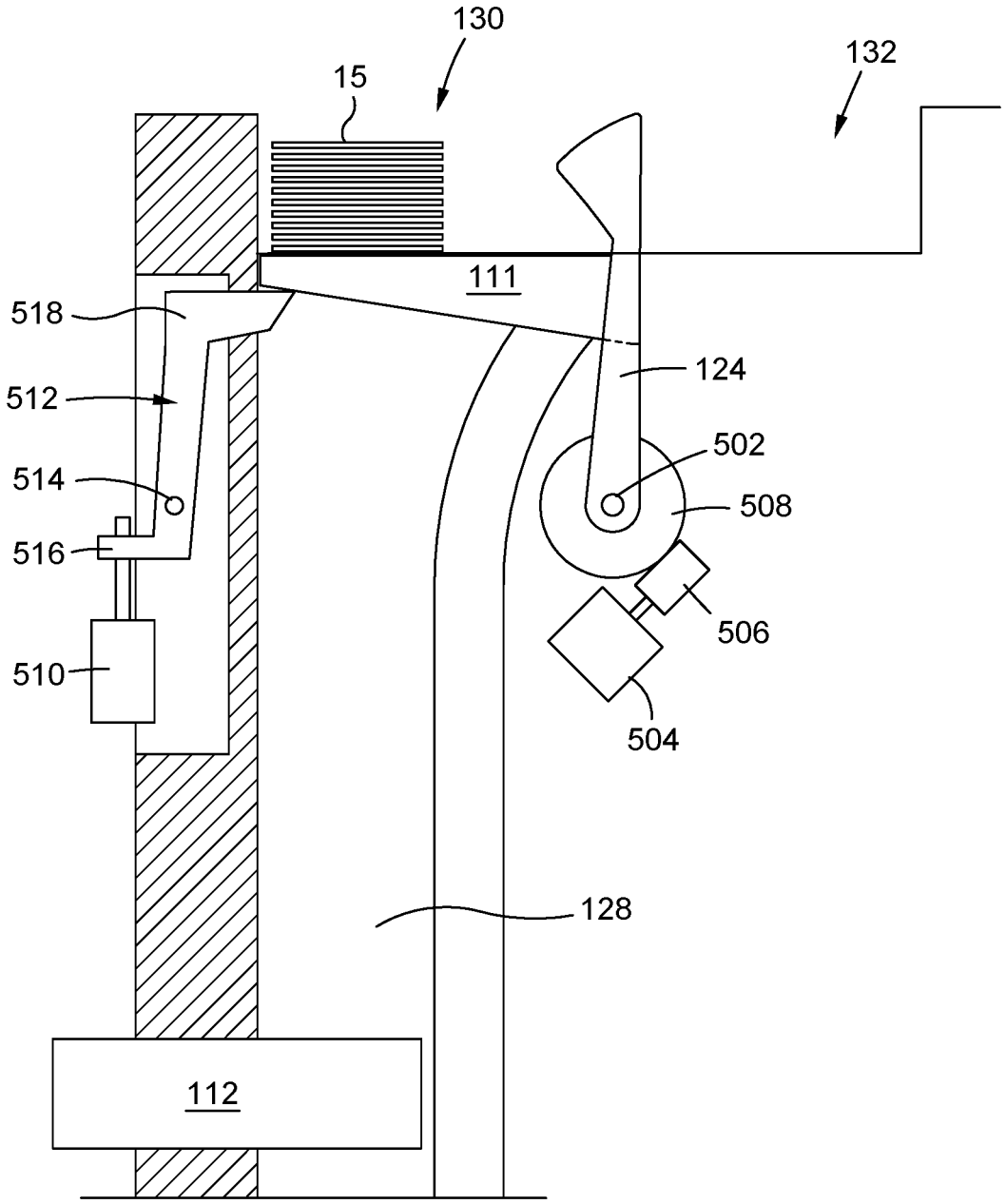
FIG. 5 shows a cross section of a card shuffler with an integrated trap door and sweeper arm, according to one exemplary embodiment.

Additional details of an embodiment of a trap door mechanism for a card handling apparatus will now be described. FIG. 5 shows a cross section of a card shuffler with an integrated trap door and sweeper arm, according to one exemplary embodiment. In this embodiment, a shuffling apparatus includes the trap door 111 on which deck of cards 15 may rest (such as by being placed on a top surface of the trap door by a user of the shuffler). The trap door 111 is shown in the closed position and forms the card receiving area 130 for a deck of cards 15 that needs to be shuffled.

The trap door 111 allows the deck of cards 15 to be placed in the receiving area 130 face down (by supporting the cards on a top surface of the trap door), while still allowing the deck of cards 15 to be shuffled while oriented vertically in the shuffling compartment 128. The trap door 111 opens to both turn the cards 90 degrees and lower the cards into the shuffling compartment 128. In particular, the trap door 111 is preferably moveable between a first position in which it is oriented generally horizontally and is capable of supporting one or more cards over or above at least a space below the trap door, such as a portion of the card shuffling compartment 128, and a second position in which it is oriented generally vertically, thus allowing the cards which were supported thereon to fall below the trap door, such as into the card shuffling compartment (such as via gravity).

In this embodiment, the control and movement of the trap door 111 is integrated or coordinated with the sweeper arm 124. As explained above, the sweeper arm 124 is configured to help raise the deck of cards 15 out of the shuffling compartment 128 and move the deck of cards 15 to the dispensing area 132. Various mechanisms may be used to move the sweeper arm 124. For example, the sweeper arm 124 may be controlled via a worm gear drive. For example, the sweeper arm 124 may have an axle 502 that is attached to a gear 508. A motor 504 may drive a worm gear 506 to rotate the sweeper arm 124.

Figure 6A:
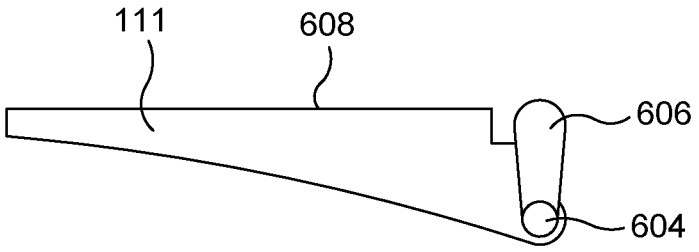
FIGS. 6A and 6B show a trap door according to an exemplary embodiment.
Figure 6B:
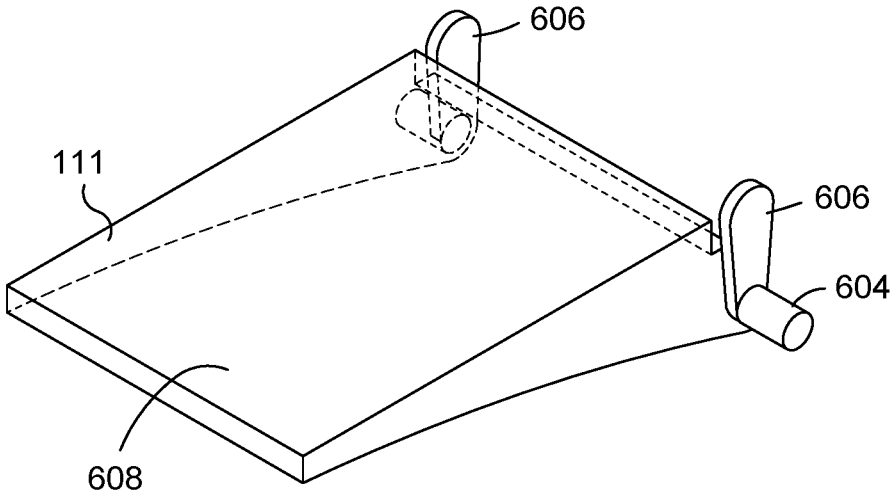

The sweeper arm 124 moves from a first position upright as shown in FIG. 5 through a range of approximately 120 degrees from the first position (in one embodiment, the sweeper arm 124 moves from the generally vertical or 12 o'clock position in FIG. 5 counter-clockwise to about an 11 o'clock position to sweep a deck of cards 15 to be shuffled into the shuffling compartment 128, then rotates further counter-clockwise to about the 7 or 8 o'clock position (e.g. approximately 120 degrees from the original vertical position) to a position in which the sweeper arm 124 does not impede shuffling of the cards or movement of the elevator 112, and then rotates back clockwise to about the 9 o'clock position to pick up the shuffled cards and then rotates back to the 12 o'clock position to deposit the shuffled cards in the dispensing area 132. This allows the sweeper arm 124 to be out of the shuffling compartment 128 during shuffling, and to lift the cards from the elevator 112 and push the cards over to the dispensing area 132 after shuffling by moving from the second position back to the first position. As described in more detail below, movement or actuation of the trap door 111 may be coordinated with a trap door latching system which, in the embodiment illustrated in FIG. 5, includes a solenoid 510, latching device 512 having a first end 516 and a second end 518, and which is rotatably mounted, such as about a hinge 514, The movement of the sweeper arm 124 between the first and second positions also controls the trap door in this embodiment. FIGS. 6A and 6B show a trap door according to an exemplary embodiment. In FIGS. 6A and 6B, the trap door 111 comprises a cam following surface 606 that is attached to an axle 604 of the trap door 111. In this example, the cam followers 606 are disposed on either side of a platform portion 608 of the trap door 111.

The cam followers 606 are configured to come into contact with the sweeper arm 124. In this manner, when the sweeper arm 124 is in the first position (see FIG. 5), the sweeper arm 124 engages the cam following surface 606 to hold the trap door 111 level such that it may receive the deck of cards 15 face down on the platform portion 608. When the sweeper arm 124 moves to the second position, the trap door 111 can open to rotate the deck of cards 15 and drop them into the shuffling compartment 128. Similarly, when the sweeper arm 124 returns from the second position to the first position (see FIG. 5), the sweeper arm 124 engages the cam following surfaces 606 of the trap door 111 to close the trap door 111 (by rotating it clock-wise in the figures as illustrated, upwardly from a vertical orientation to a horizontal orientation). This allows for integrated control of the sweeper arm and trap door using a single motor and gear system.

Importantly, in a preferred embodiment of the invention, the trap door 111 is rotated from its first to its second position, such as about one end of the door. This not only allows cards which are placed thereon to fall into the space below the trap door (the card shuffling compartment 128 in this case), but causes the cards to move from a horizontal orientation (while sitting on the trap door) to a vertical orientation (as they fall into the card shuffling compartment, thus allowing the cards to be shuffled by a shuffling mechanism in their vertical orientation with in the card shuffling compartment).

As indicated above, and as illustrated in FIG. 5, to stabilize the trap door 111 when closed, a latching system may be utilized. As indicated above, the latching system may comprise a solenoid 510 connected to a latching device 512. The latching device may be installed on a hinge 514 such that the latching device 512 can rotate about the hinge 514. The latching device may include a first end 516 that is connected to and driven by the solenoid 510. A second end 518 opposite the first end engages the trap door 111 to maintain the trap door 111 in the closed position.

When a deck of cards 15 is to be shuffled, the solenoid 510 is actuated to move the latching device 512 such that the second end 518 disengages from the trap door 111. The trap door 111 may then be controlled via the sweeper arm 124 as described above. When the trap door 111 is brought back to the closed position, the solenoid 510 is actuated such that the second end 518 of the latching device 512 reengages with the trap door, holding it closed.

Other modifications are also possible. For example, instead of the integrated trap door and sweeper arm, the trap door may be provided with a second motor and gear system. In some instances, by controlling the trap door independently, the solenoid and latch may be omitted.

It will be appreciated that trap door mechanism may be utilized independent of a sweeper arm in some embodiments. For example, in one variation of a card shuffling mechanism, cards may be placed on the trap door and allowed to drop into a card shuffling area or other area. In such a configuration, a card elevator or other mechanism (other than a card sweeper) might be used to move the cards back from the card shuffling area upwardly to a card dispensing area.

As noted above, other mechanism or means may be provided for selectively moving the trap door from its first, horizontal supporting position to its second, generally vertically extending position (at which time the cards are preferably allowed to fall, via gravity, into a space below the trap door).

In the embodiment illustrated, the trap door 111 has a first side and a second side and the trap door rotates, pivots or tilts about its second side. In another embodiment, the trap door 111 might be configured to pivot or rotate about an axis through the middle of the trap door. In some embodiments, the trap door might even be configured to slide, such as by being moved horizontally into a position in which the trap door no longer supports the cards and thus allows them to fall into the space below (such as the card shuffling compartment).

Operation or movement of the trap door mechanism may be controlled or triggered in various manners. For example, in one embodiment the card handling mechanism, such as the shuffler, may include a "start" or "shuffle" button or the like. When a user provides input to that button (such as by depressing or touching it), a signal might be sent directly to the trap door movement mechanism to cause it to move the trap door (such as by actuating the solenoid and swing arm motor). In other embodiments, such an input might be transmitted to a main device controller which, in turn, generates and sends out one or more control signals (such as to the trap door solenoid and sweeper arm motor). Of course, other control schemes may be used to selectively controlling the operation of the trap door mechanism (including the sweeper arm, if included).

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A trap door system for a card shuffling apparatus, the trap door system comprising:

a trap door comprising a card platform, an axle disposed at a proximal end of the trap door, and a cam follower surface disposed on the axle; and a latching device configured to interact with a distal end of the trap door to hold and lock the trapdoor in a position where the card platform is substantially horizontal, the latching device comprising a first end attached to an actuator, a hinge about which the latching device rotates, and a second end that interfaces with the distal end of the trap door, wherein when the actuator rotates the latching device so that the second end is moved away from the distal end of the trap door, the trap door rotates about the axle so that the platform is substantially vertical, and wherein the cam follower surface is configured to interface with a sweeper arm to rotate the trap door about the axle from where the platform is substantially vertical to where the platform is substantially horizontal.

2. The trap door system of claim 1, wherein the actuator is a solenoid actuator.

3. The trap door system of claim 1, wherein the cam follower surface projects from the axle in a direction substantially perpendicular to the platform.

4. The trap door system of claim 3, wherein the cam follower surface is disposed on both sides of platform.

5. The trap door system of claim 1, wherein the platform defines a lower surface of a receiving area of a card shuffler.

6. A shuffling apparatus comprising:

a card receptacle having one or more sidewalls and at least one end-wall that define a card receiving/dispensing area for receiving/dispensing cards;

a shuffling compartment;

a trap door configured to transport cards from the card receiving/dispensing area to the shuffling compartment, wherein the trap door comprises a cam follower surface; and a sweeper arm configured to raise the cards from the shuffling compartment and to control rotation of the trap door by interacting with the cam follower surface.

7. The shuffling apparatus of claim 6, wherein said trap door moves between a first position in which it extends generally horizontally and a second position in which it extends generally vertically.

8. The shuffling apparatus of claim 7, wherein said trap door has a top surface, said top surface which supports one or more playing cards above said shuffling compartment when said trap door is in said first position.

9. The shuffling apparatus of claim 6, wherein the trap door comprises an axle, and the cam follower surface extends out from the axle.

10. The shuffling apparatus of claim 8, wherein the cam follower surface is disposed on both sides of the top surface.

11. The shuffling apparatus of claim 6, further comprising a motor connected to the sweeper arm via one or more gears, the motor actuating the sweeper arm and indirectly actuating the trap door via the cam follower surface.

12. The shuffling apparatus of claim 11, wherein the one or more gears comprise a worm gear.

13. The shuffling apparatus of claim of claim 7, further comprising a trap door latching system comprising a first end connected to an actuator and a second end interfacing with the trap door to lock the trap door in the first position.

14. The shuffling apparatus of claim 13, wherein the actuator is a solenoid actuator.

* * * * *